US007900684B2

(12) United States Patent
Norris et al.

(10) Patent No.: US 7,900,684 B2
(45) Date of Patent: Mar. 8, 2011

(54) IN-PLACE COPE MOLDING FOR PRODUCTION OF CAST METAL COMPONENTS

(75) Inventors: William J Norris, West Allis, WI (US); Craig A Smith, Waukesha, WI (US)

(73) Assignee: Waukesha Foundry, Inc., Waukesha, WI (US)

( * ) Notice: Subject to any disclaimer, the term of this patent is extended or adjusted under 35 U.S.C. 154(b) by 341 days.

(21) Appl. No.: 12/131,657

(22) Filed: Jun. 2, 2008

(65) Prior Publication Data

US 2009/0020254 A1 Jan. 22, 2009

Related U.S. Application Data

(60) Provisional application No. 60/949,984, filed on Jul. 16, 2007.

(51) Int. Cl.
*B22C 9/02* (2006.01)

(52) U.S. Cl. ..... 164/29; 164/364

(58) Field of Classification Search ..... 164/29, 164/364, 384
See application file for complete search history.

(56) References Cited

U.S. PATENT DOCUMENTS

| | | | | |
|---|---|---|---|---|
| 3,554,271 | A | 1/1971 | Goss | |
| 3,730,250 | A | 5/1973 | Fellows | |
| 3,830,279 | A | 8/1974 | Arbenz | |
| 4,027,717 | A | 6/1977 | Mio | |
| 4,121,646 | A | 10/1978 | Rikker | |
| 4,641,703 | A | 2/1987 | Voss | |
| 4,693,292 | A | 9/1987 | Campbell | |
| 4,694,879 | A | 9/1987 | Feuring | |
| 4,791,975 | A | 12/1988 | Wuepper | |
| 4,836,266 | A | 6/1989 | Wuepper | |
| 4,976,303 | A | 12/1990 | Wuepper | |
| 5,503,214 | A | 4/1996 | Cribley | |
| 5,540,871 | A | 7/1996 | Uchida | |
| 6,349,757 | B1 | 2/2002 | Vorndran | |
| 6,386,264 | B2 * | 5/2002 | Gustafson | 164/17 |
| 6,637,497 | B2 | 10/2003 | Herron | |
| 6,892,788 | B2 | 5/2005 | Schreiner | |
| 7,082,984 | B2 | 8/2006 | Rizzo | |
| 2005/0072551 | A1 | 4/2005 | Sorokin et al. | |

FOREIGN PATENT DOCUMENTS

| | | | |
|---|---|---|---|
| JP | 6-71379 | * | 3/1994 |
| WO | 2004096425 | | 11/2004 |

* cited by examiner

*Primary Examiner* — Kuang Lin

(74) *Attorney, Agent, or Firm* — Brian G. Gilpin; Godfrey & Kahn, S.C.

(57) ABSTRACT

In-Place Cope Molding or "IPCM," is designed to reduce or eliminate certain inefficiencies present in traditional molding techniques during production of the cope half of a sand mold. IPCM allows the cope half of the mold to be produced on top of the drag half of the mold by use of a separation barrier which supports the sand above the mold cavity in the drag. This method reduces or eliminates parting line flash, and also avoids the need to turn over or otherwise handle the cope, allowing the cope to be made thinner than a traditional cope and allowing for lower material costs.

14 Claims, 13 Drawing Sheets

IN-PLACE COPE MOLDING FOR PRODUCTION OF CAST METAL COMPONENTS

CROSS REFERENCE TO RELATED APPLICATION

This application claims the benefit of provisional U.S. Application No. 60/949,984, filed Jul. 16, 2007, which is specifically incorporated herein by reference, under 35 U.S.C. §119(e).

FIELD OF THE INVENTION

The present invention relates to metal founding, and more particularly to a method of making a sand-based mold which improves the casting process by reducing the amount of materials and time necessary to produce the mold. It also includes molds made using the process.

BACKGROUND

Traditional foundry sand molding processes typically employ a two-part mold consisting of a lower half (drag) and an upper half (cope). These two halves are normally produced using the same process: a sand/binder mixture is poured onto a pattern which forms the molding or rigging cavities. When the sand binders have set, the mold and pattern are turned over and the pattern is extracted from the mold. During the mold closing process, the cope half is turned over again and placed on top the drag, forming a complete mold.

A more advanced molding technique, known as patternless molding, differs from the above in that two solid blocks of sand are molded without the use of a pattern. The mold and rigging cavities are then machined into the sand blocks forming the cope and drag. Again, the cope half is turned over and placed on top the drag during mold closing.

There are several inefficiencies inherent in both processes. First, the cope and drag sections must be thick enough to have sufficient strength to withstand the stresses produced during the turnover processes. The amount of sand and binder used for each mold is thus usually far greater than the amount needed otherwise for strength during the pouring process or that needed for thermal insulation. Second, the turnover and mold closing processes take time. And third, inaccuracies in the molding process (including dimensional changes during the binder curing) can create gaps between the cope and drag. During pouring, metal fills these gaps creating "flash" that must be removed by grinding the resulting casting.

Accordingly, a need exists to improve the efficiency of the casting process by reducing the amount of materials necessary to form the cope and reducing the time required to complete the full mold and reducing the amount of flash.

SUMMARY

The process, hereinafter referred to as In-Place Cope Molding or "IPCM," is designed to reduce or eliminate certain inefficiencies inherent in the traditional molding techniques, particularly during production of the cope half of a sand mold.

IPCM allows the cope half of a mold to be produced directly on top of the drag half of the mold by use of a separation barrier which supports the sand above the mold cavity in the drag. The introduction of the barrier, which supports the sand above the mold and rigging cavities in the drag, allows a thinner cope layer to be molded on top of the drag half, eliminating the need to handle the cope half separately.

DETAILED DESCRIPTION

Figure 1:
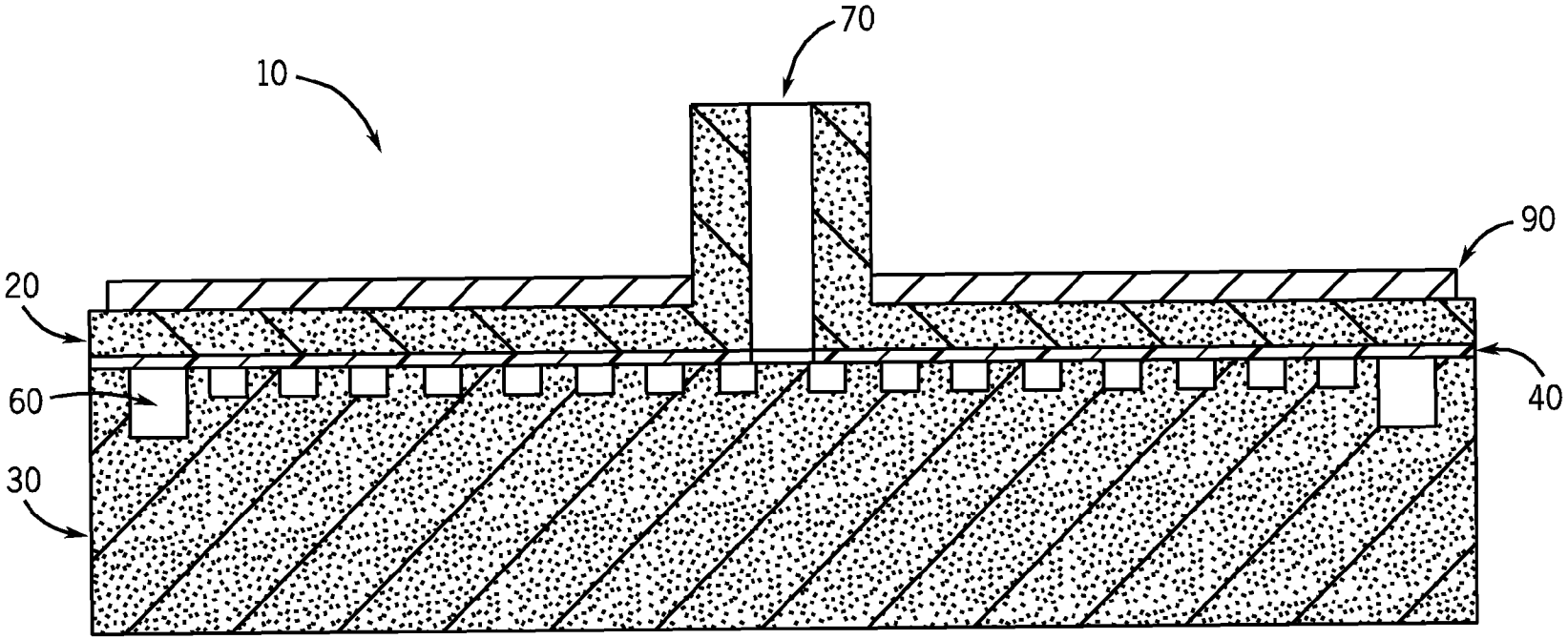
FIG. 1 is a cross-sectioned side view of a cutaway of the full mold.

The process known as In-Place Cope Molding ("IPCM") is designed to reduce or eliminate certain of the inefficiencies of the traditional methods during production of the cope half 20 of a foundry sand mold 10. IPCM allows the cope half 20 of the mold 10 to be produced directly on top of the drag half 30 of the mold 10 by use of a separation barrier 40 which supports the cope layer 20 above the mold cavity 60 of the drag 30. FIG. 1 shows a cross-section of such an approach.

The mold 10 consists of a lower mold half or "drag" layer 30, which may be molded using traditional foundry techniques employing a pattern around which a chemically or thermally bonded sand (e.g. silica sand mixed with phenolic urethane binder and other additives) is packed. The drag 30 of the mold 10 may be formed by any traditional method. Once the sand has been cured, the pattern is removed and the resulting mold cavity forms a negative image of the part to be cast. Other molding techniques such as permanent molds or patternless molds where the mold cavity is produced by machining the cavity into a block of bonded sand, may also be employed.

In the prior art, using any of the existing molding techniques, a second, upper layer or "cope" layer 20 is then molded separately and must be "turned over" or "rolled over" and placed on top of the drag 30. In order to withstand the stresses of the turnover process, the drag 30 and cope 20 must be thick enough to provide sufficient strength. The amount of sand and binder used for each mold 10 is thus usually much greater than the amount needed otherwise for strength during the pouring process or that needed for thermal insulation. Traditional molding would typically require a cope 20 thickness of 6" to 10."

The IPCM process of the present invention provides increased advantages over the traditional methods described above by eliminating the time-consuming and costly turn-over process by allowing production of the cope 20 on top of the drag 30, and in turn necessitating the need for only a very thin cope 20. Copes 20 using the IPCM process may be made as thin as 1" or less, as handling strength is no longer a consideration. This significantly thinner cope layer 20 requires a significantly smaller amount of sand and binder materials. This is important because sand and binder costs often represent a significant portion of the mold costs, particularly if expensive additives are used.

Figure 2:
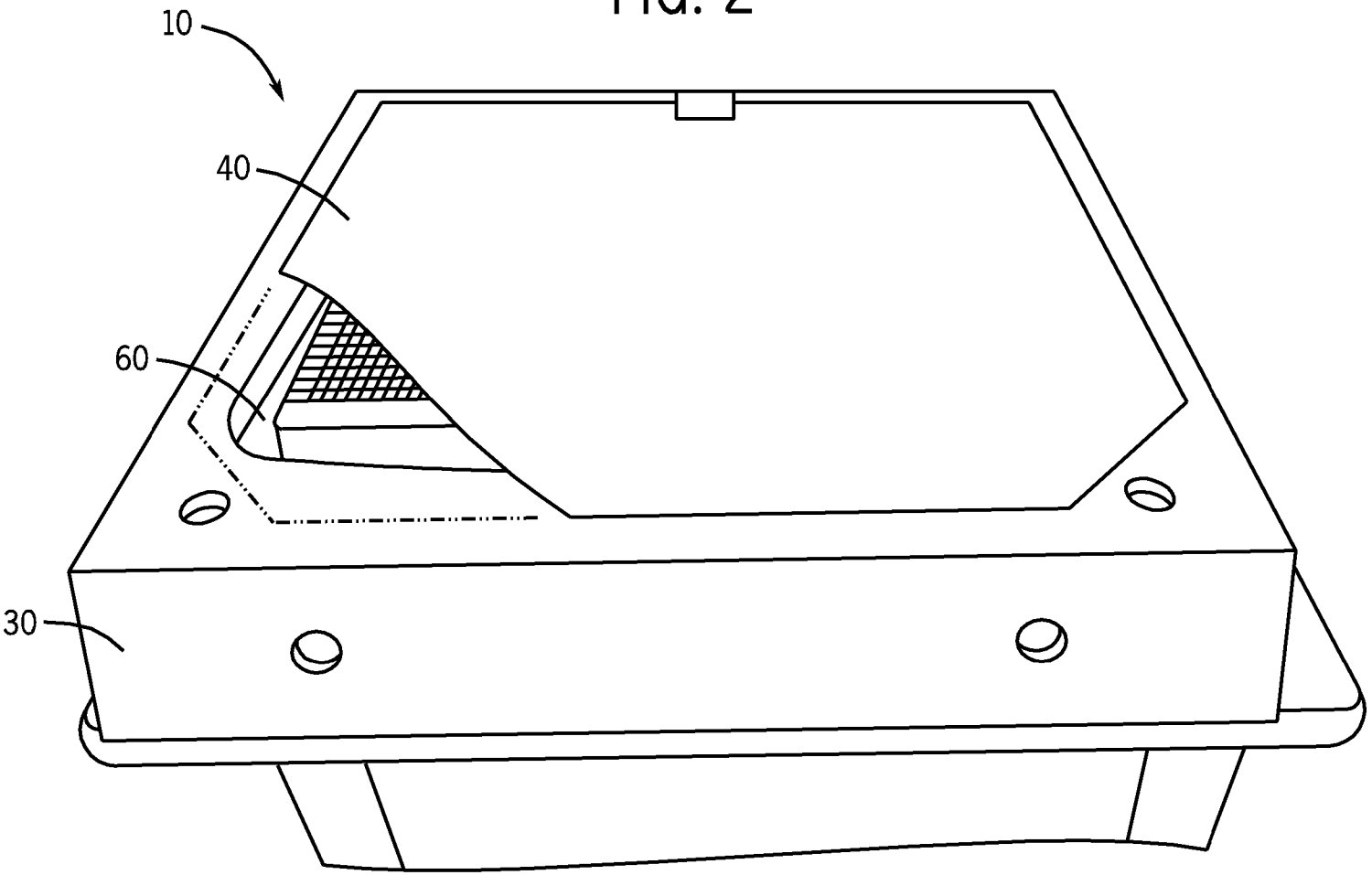
FIG. 2 is top perspective view of the drag layer with a barrier partially in place.
Figure 3:
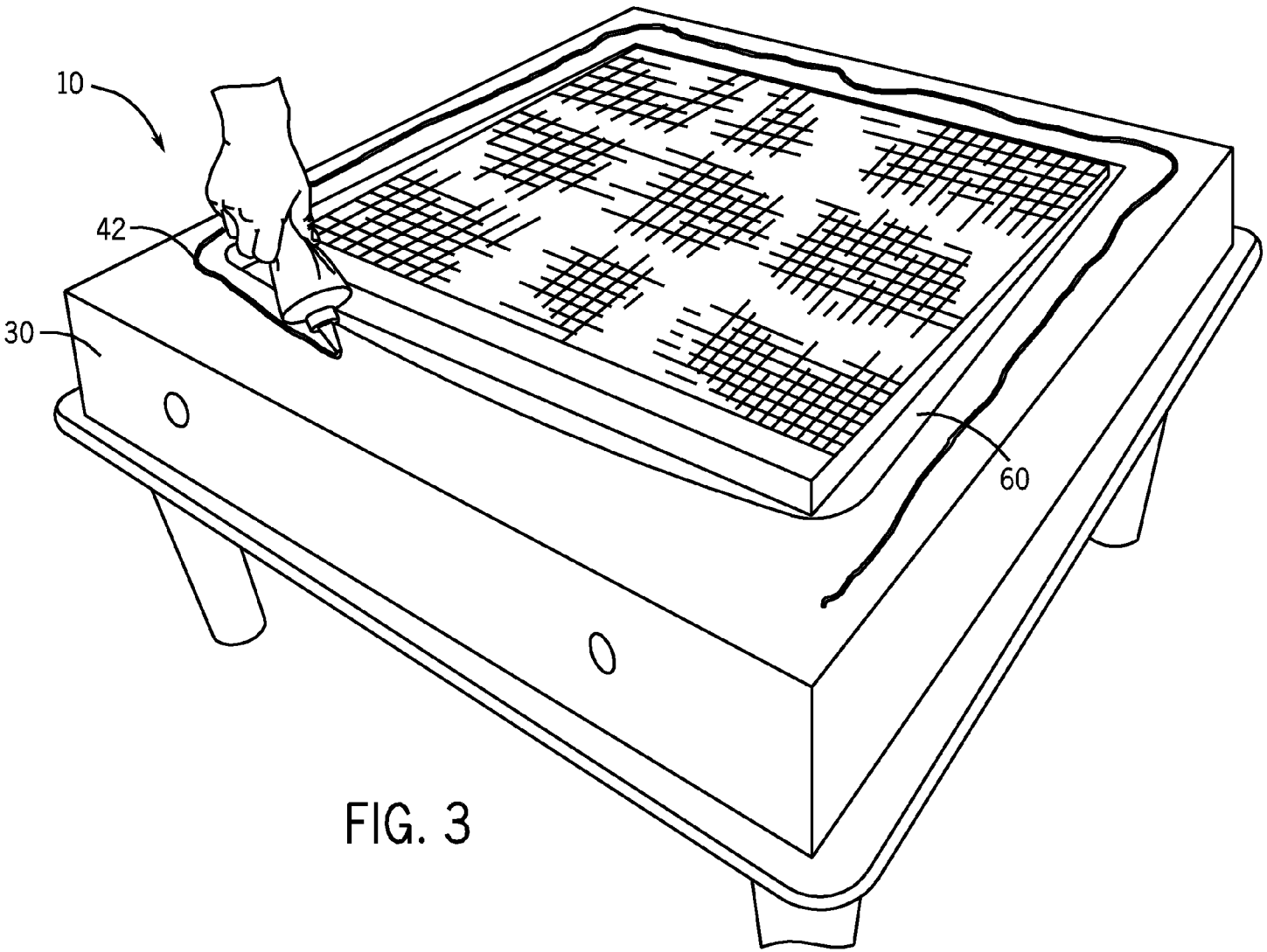
FIG. 3 is a top perspective view of the mold cavity and the application of barrier glue.
Figure 4:
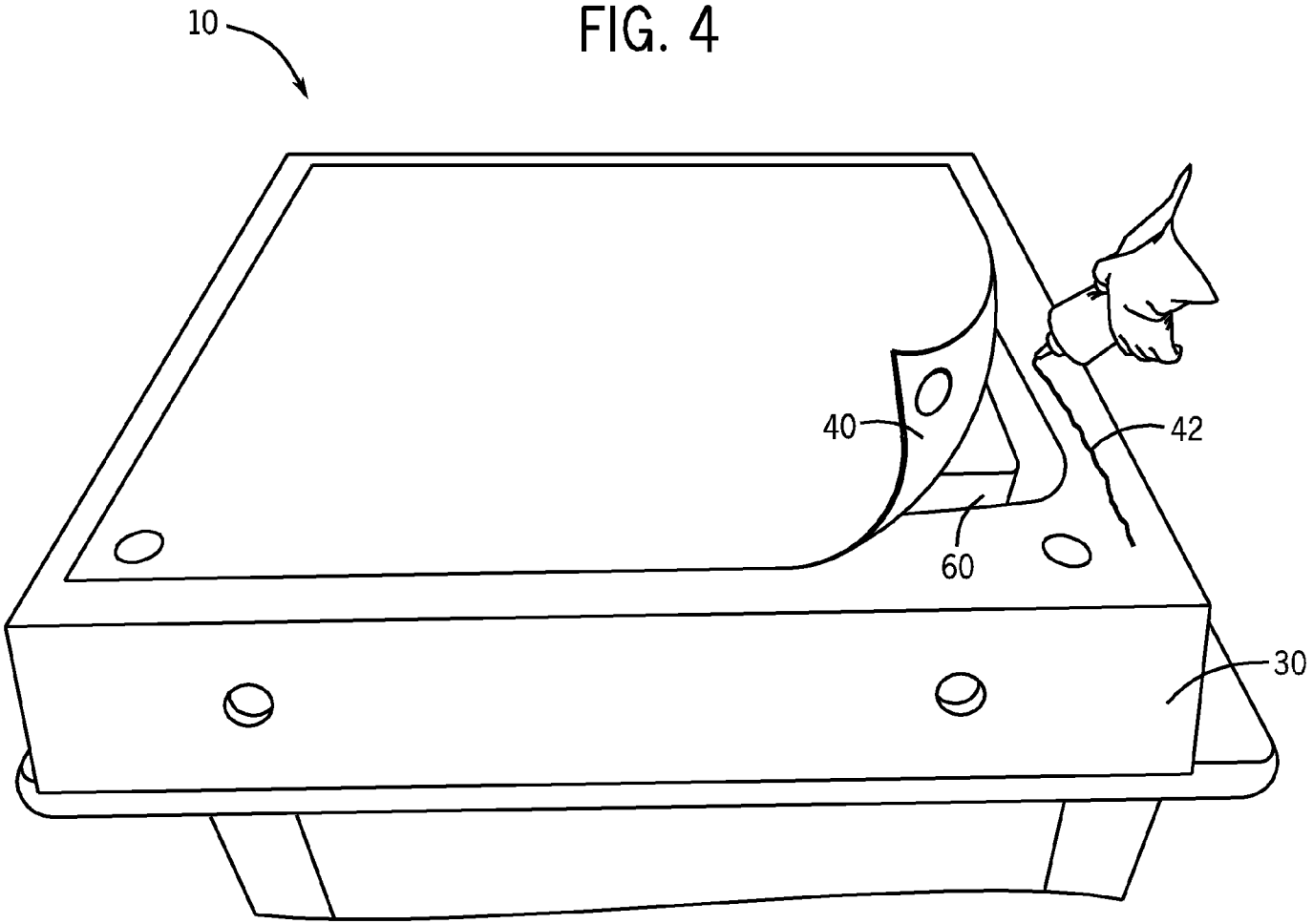
FIG. 4 is a top perspective view of a mica barrier being glued in place.
Figure 5:
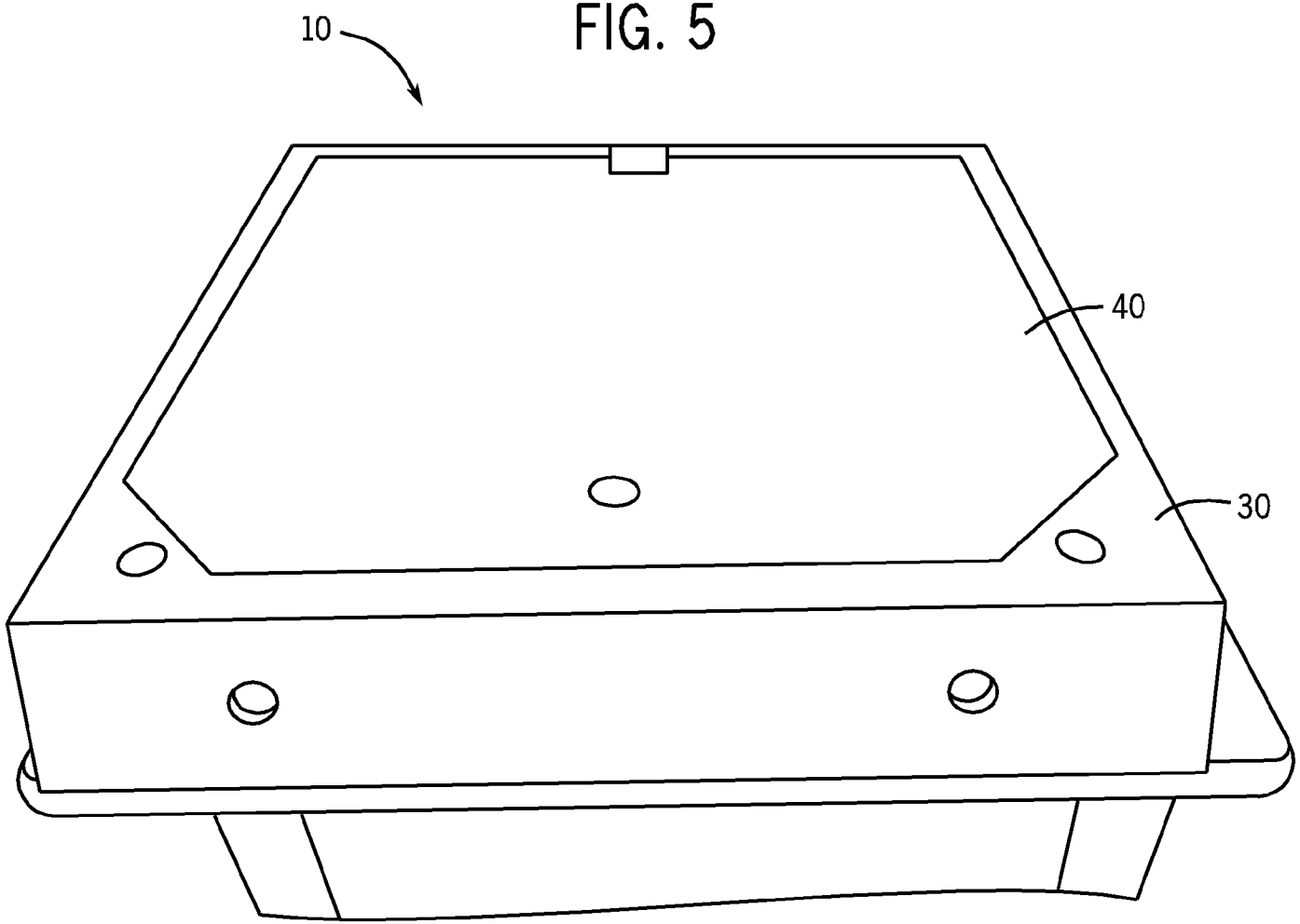
FIG. 5 is a top perspective view of the drag layer with a barrier secured in place.
Figure 6:
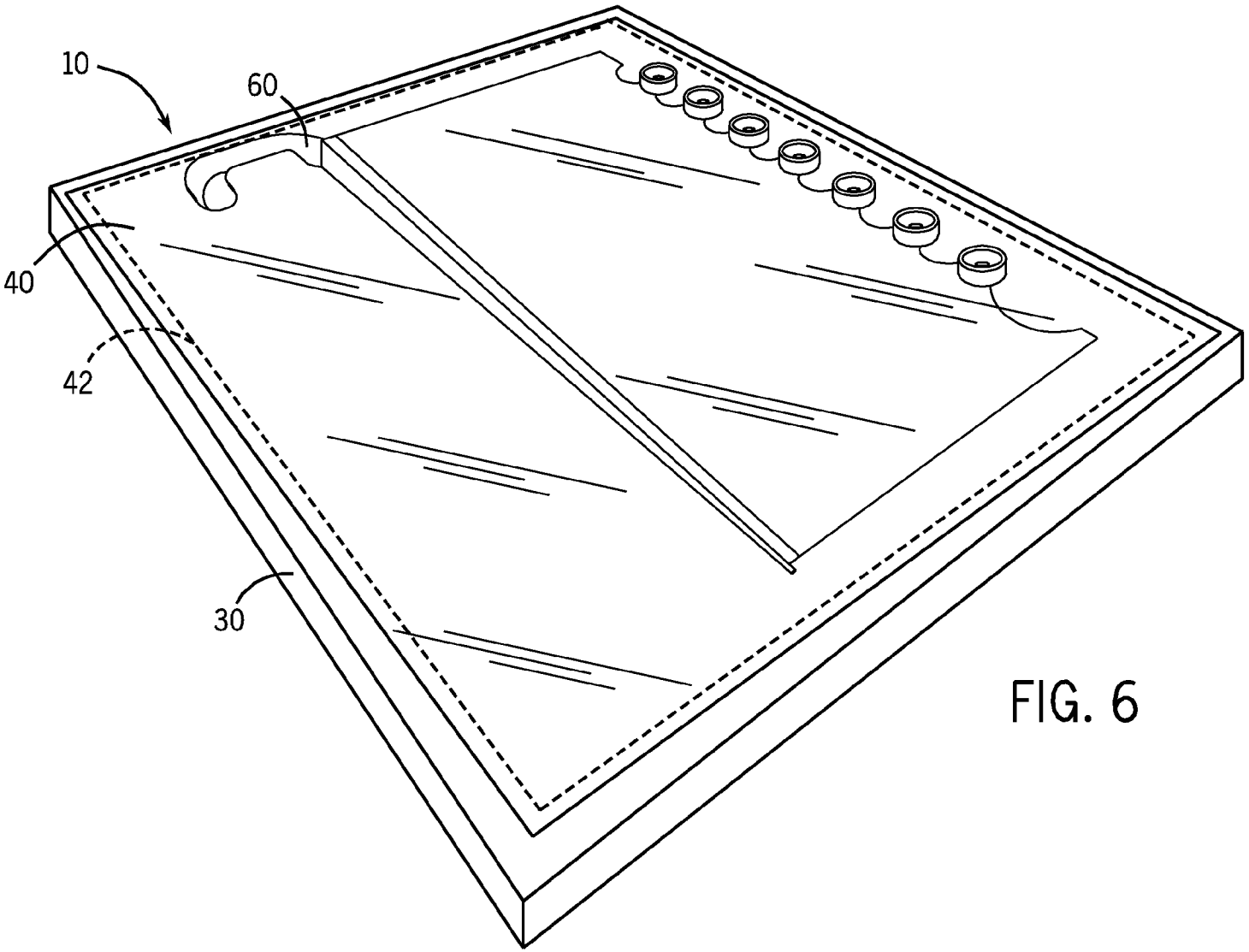
FIG. 6 is a top perspective view of a heat-shrinkable plastic film barrier taped in place.

Important to the IPCM process is the introduction of a barrier 40 which supports the cope layer 20 above the mold cavity 60 in the drag 30. As seen in FIG. 1, the barrier 40 supports the sand above the mold cavity 60 in the drag 30, and allows a thinner cope 20 to be molded on top of the drag 30. This avoids the need to turn over the cope half 20 onto the drag 30, reducing labor and costs necessary to perform this step in the traditional processes. FIG. 2 shows a barrier 40 partially in place on top of the drag layer 30. The barrier 40 may be affixed to the drag 30 above the mold cavity 60 by use of an adhesive 42 (such as an epoxy, hot melt, or any other suitable foundry adhesive) as shown in FIGS. 3-5. Other means of affixing the barrier 40, such as mechanical pinning using nails, staples, tape (FIG. 6), or interlocking sand, may also be used.

Because the cope 20 can be relatively thin in the IPCM process, the barrier 40 can be made of relatively weak materials compared to those used in traditional molding processes. An appropriate barrier 40 is selected to suit the particulars of the mold 10 to be made. The material used for the barrier 40 is selected to have: 1) sufficient strength to support the sand in the cope 20 until the binders in the sand/binder mixture set; 2) adequate gas permeability to allow venting during pouring of the molten metal into the mold cavity 60; and 3) sufficient flexibility to form to the shape of the highest points of the drag 30. Examples of materials used successfully for this barrier 40 include paper, plastic film (FIG. 6), refractory felt, and mica paper (FIG. 4). For example, a thin, high tensile strength paper may be used if the open areas of the mold cavity 60 are relatively narrow. Such thin paper would minimize the risks of producing flash which forms as the paper is combusted during pouring of the mold 10. Paper has an added advantage of being extremely low cost. A compressed mica paper or board might be used for applications where a stronger barrier 40 is needed to support greater spans across larger mold cavities 60 or mold cavities 60 with wider open areas. If mica paper is used, the mica does not combust at all, so flash is kept to a minimum regardless of the thickness of the barrier 40. On the other hand, the stiffness of the mica as compared to paper may reduce the conformance of the sand of the cope 20 to the drag 30. Of course, a wide variety of materials could be used for the barrier 40.

Figure 7:
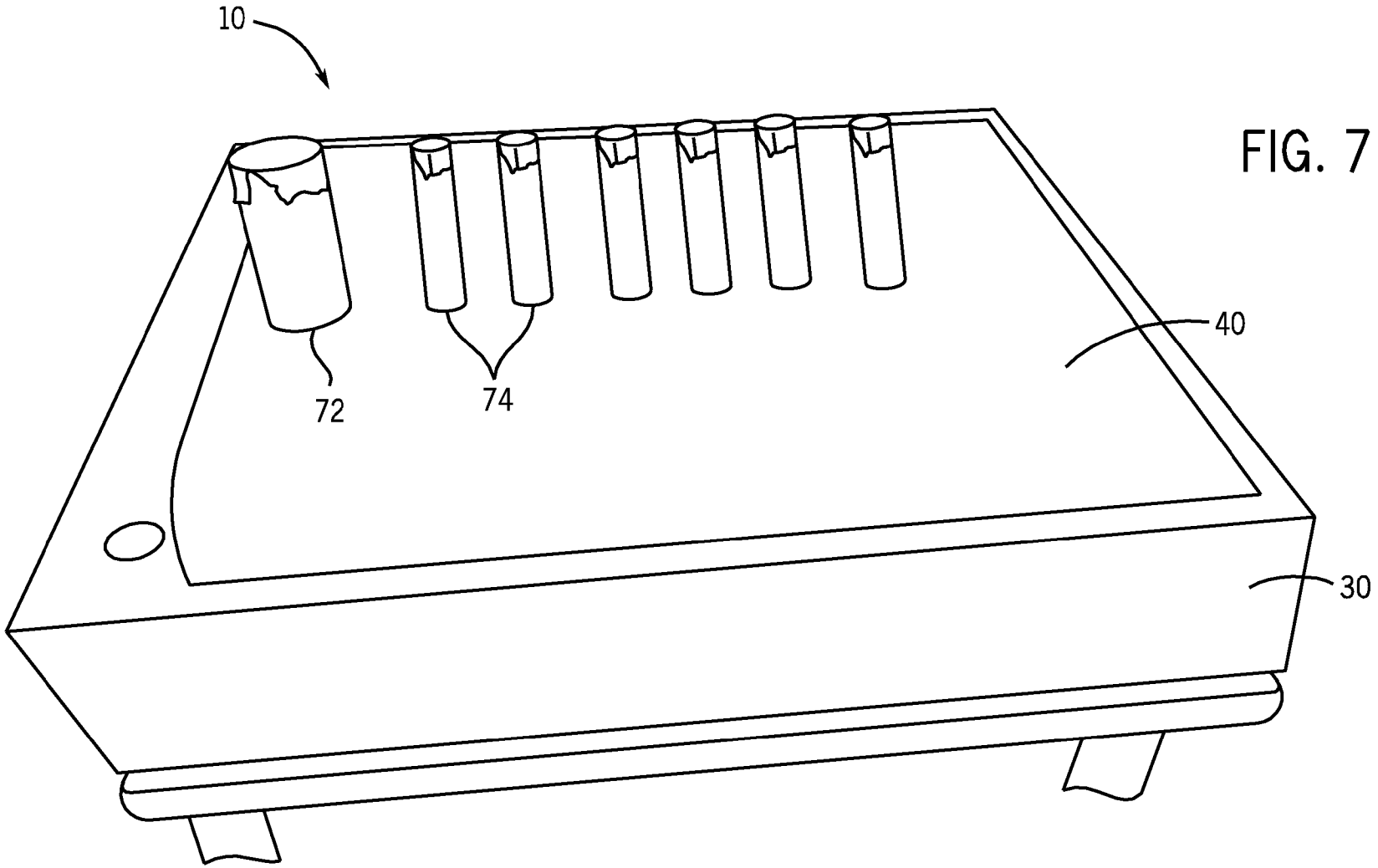
FIG. 7 is a top perspective view showing sleeves forming sprue and flow-offs glued to a barrier.
Figure 8:
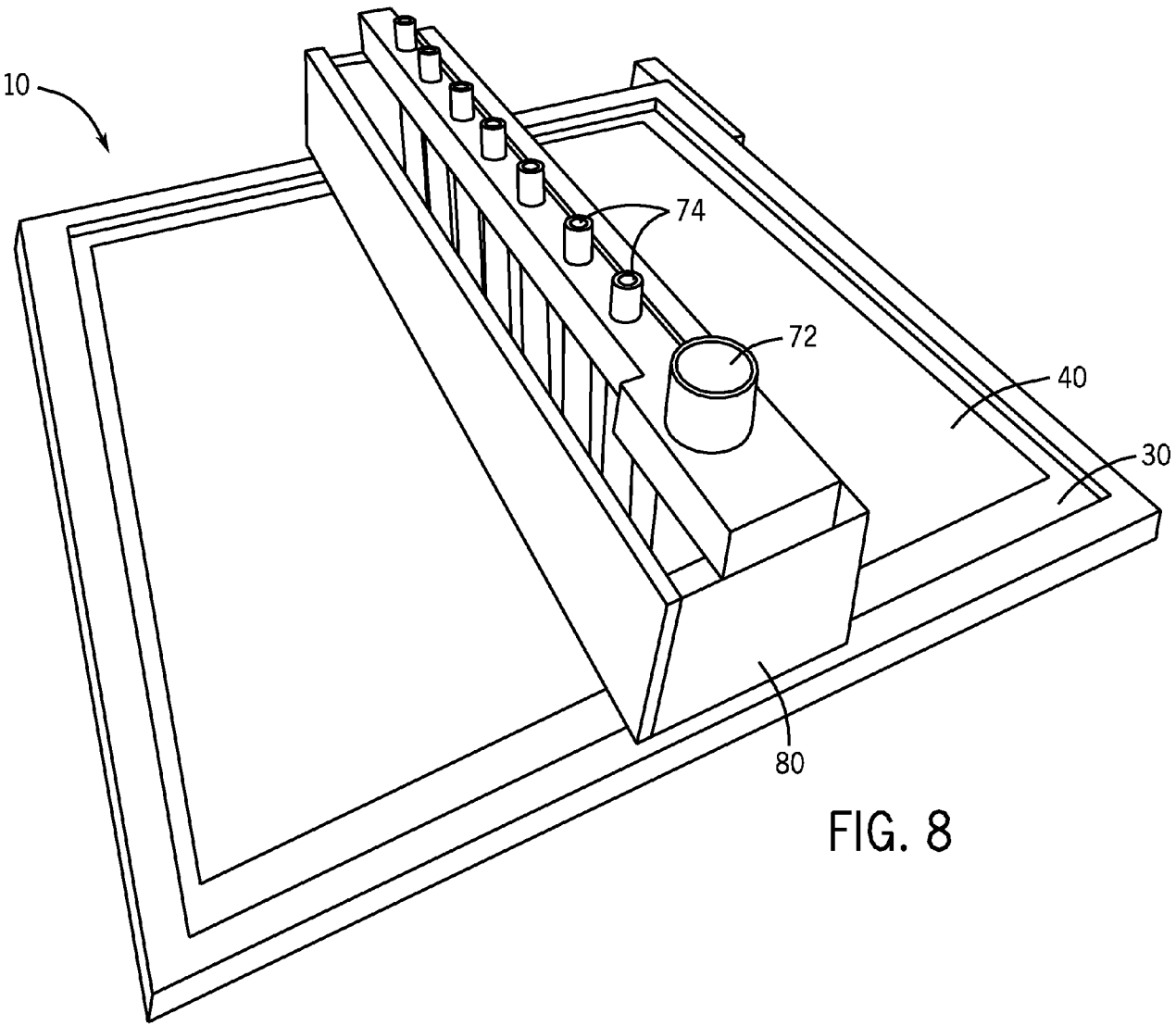
FIG. 8 is a top perspective view of sprue and vents in place on top of a barrier.

Once the barrier 40 has been affixed to the drag 30, sleeves forming the vents 70, sprues 72, flow-offs 74 or other rigging cavities are attached to or through the top of the barrier 40 as shown in FIG. 7. The sprue 72 is the entryway for metal to fill the mold cavity 60. Vents 70 are passages designed to allow the air in the mold cavity 60 and gasses formed during pouring to escape. Flow-offs 74 function similar to vents, but also allow a substantial volume of the first metal that enters the mold cavity 60 to flow into them (this metal typically contains a higher volume of contaminants). In another embodiment, risers (not shown) may also be attached to or through the top of the barrier 40 along with the vents 70, sprues 72 and flow-offs 74. Risers are reservoirs which fill with liquid metal and are designed to be the last metal to solidify, thereby providing metal to fill the voids which form from the volumetric reduction during solidification. Vents 70 and flow-offs 74 are subsequently removed from the casting during finishing. For additional support of the sleeves forming the sprue 72, vents 70 and flow-offs 74, these components may be supported using forms 76 as shown in FIG. 8. Vents 70, sprues 72, flow-offs 74 and risers may be molded in the cope 20 using sleeves, plugs or patterns that may be removed from the top surface of the cope 20. In addition, rigid foam, e.g. polystyrene foam, may be used to mold such components, and removal of the foam may be unnecessary as it is combusted by the molten metal during the pouring process.

Figure 9:
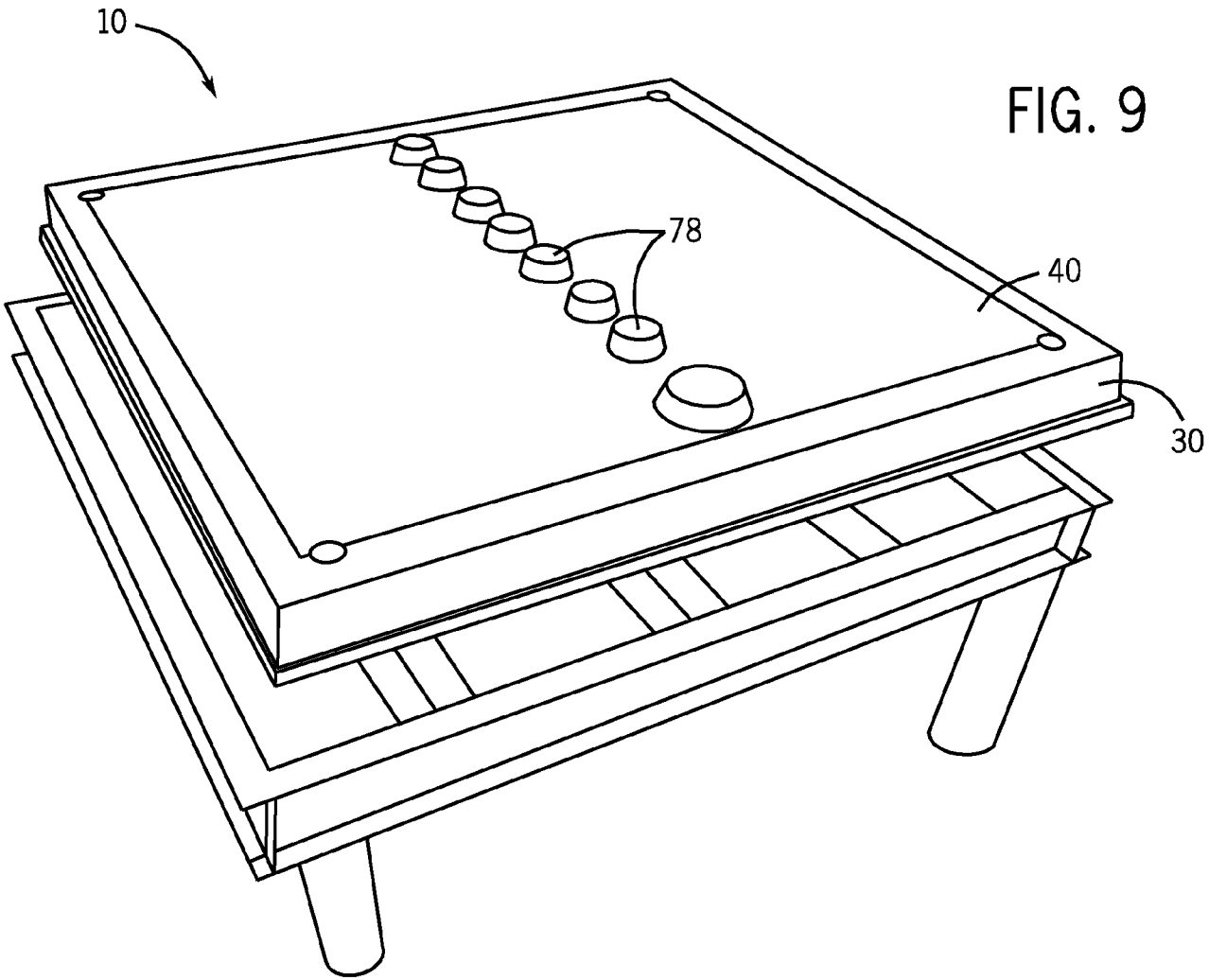
FIG. 9 is a top perspective view of breaker cores glued to the top of a barrier for positioning sprue and flow-off sleeves.
Figure 10:
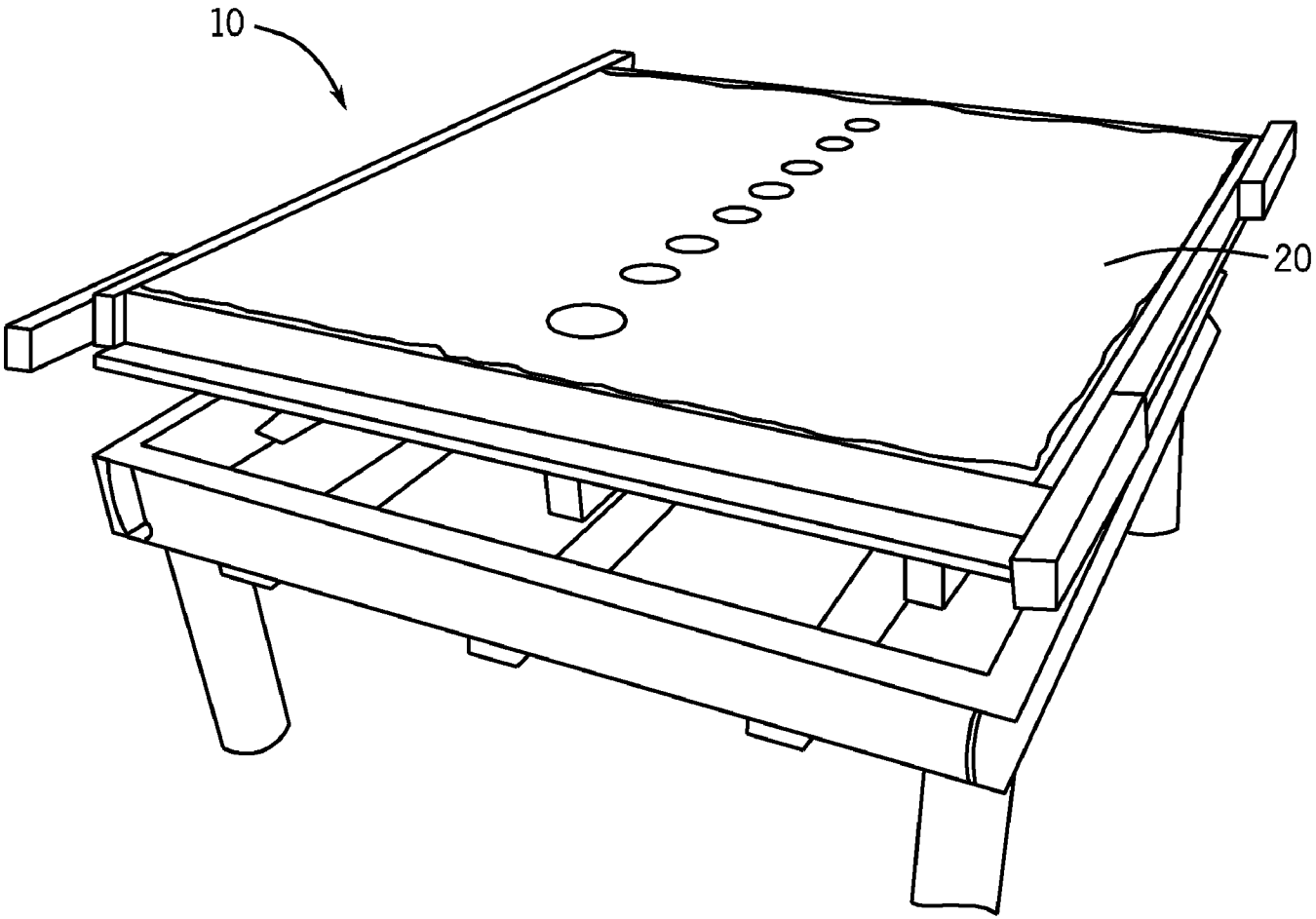
FIG. 10 is a top perspective view showing a thin layer of bonded sand distributed over a barrier.
Figure 11:
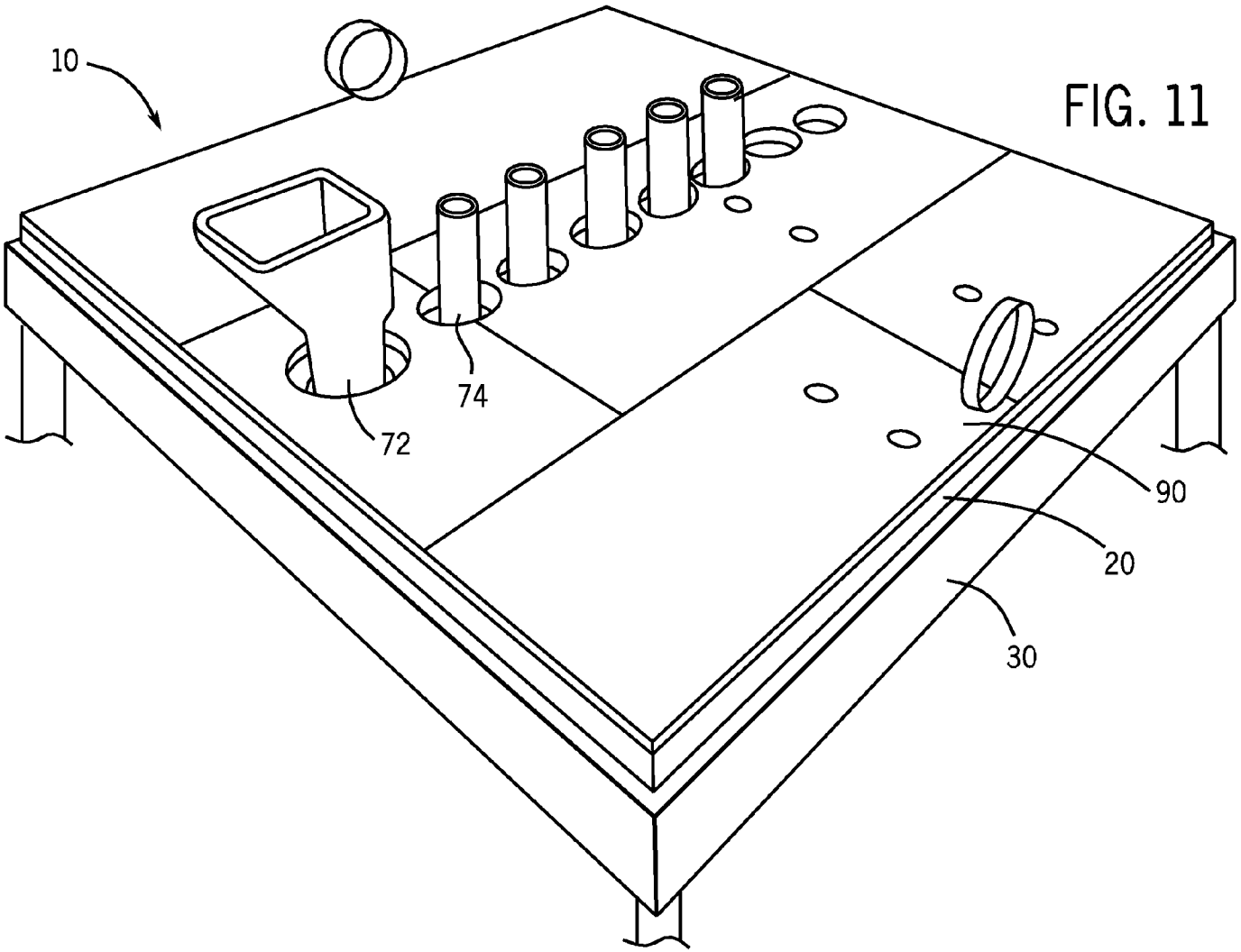
FIG. 11 is a top perspective view showing sprue and flow-off sleeves attached to breaker cores and a cope plate position on top of a cope layer.

FIG. 9-11 show a process where sand cores known as "breaker cores" 78 affixed to the barrier 40 are used to locate and anchor the sleeves for the sprue 72, vents 70, flow-offs 74. These cores 78 may also serve to allow easy removal of the flow-offs 74 after casting by producing a small, easily broken connection. The cope 20 is then created by distributing the sand/binder mixture over the barrier 40 as shown in FIG. 10.

If a very thin cope 20 is used, sufficient weight and strength to resist the forces from the molten metal are provided by a cope plate 90, which is a steel plate placed on the cope 20 before the binder in the sand sets. The cope plate 90 is placed on top of the cope 20 and the sprue 72 and flow-off 74 sleeves are attached to the breaker cores 78, as shown in FIG. 11. The cope plate 90 serves to provide strength to the thin sand cope 20 and to add weight or to distribute clamping force to the cope 20 to counteract the forces created by the pressure of the molten metal filling the mold cavity 60 attempting to "float" the cope 20.

Figure 12:
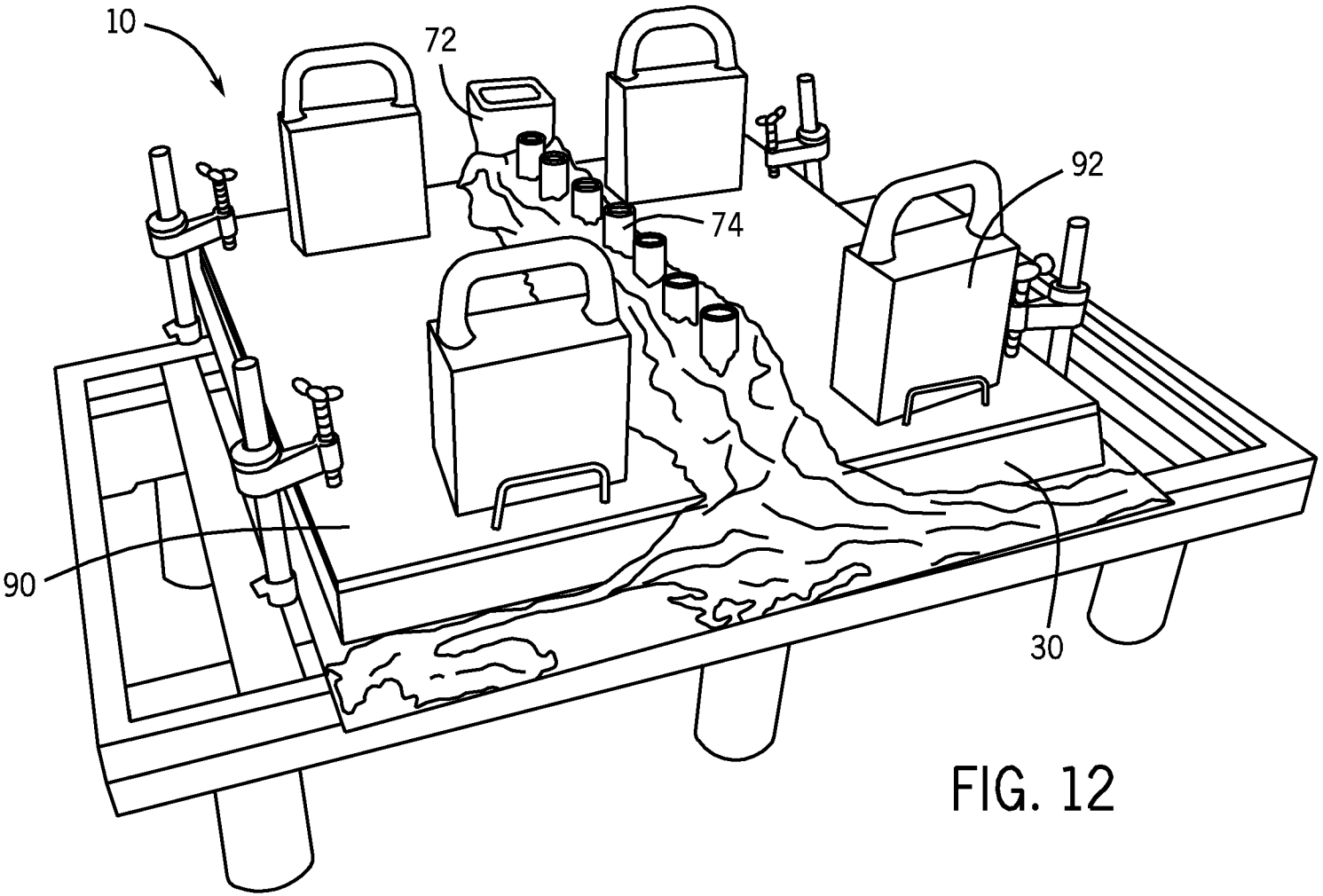
FIG. 12 is a top perspective view of a finished mold.

Finally, as show in FIG. 12, the sprue 72 and flow-off 74 sleeves are anchored by packing their bases in bonded sand, the cope plates 90 are clamped to the mold 10 base and weights 92 are added to counteract the pressure of the molten metal, and the cope plate 90 is covered in unbonded sand to shield it from damage from spilled molten metal.

Figure 13:
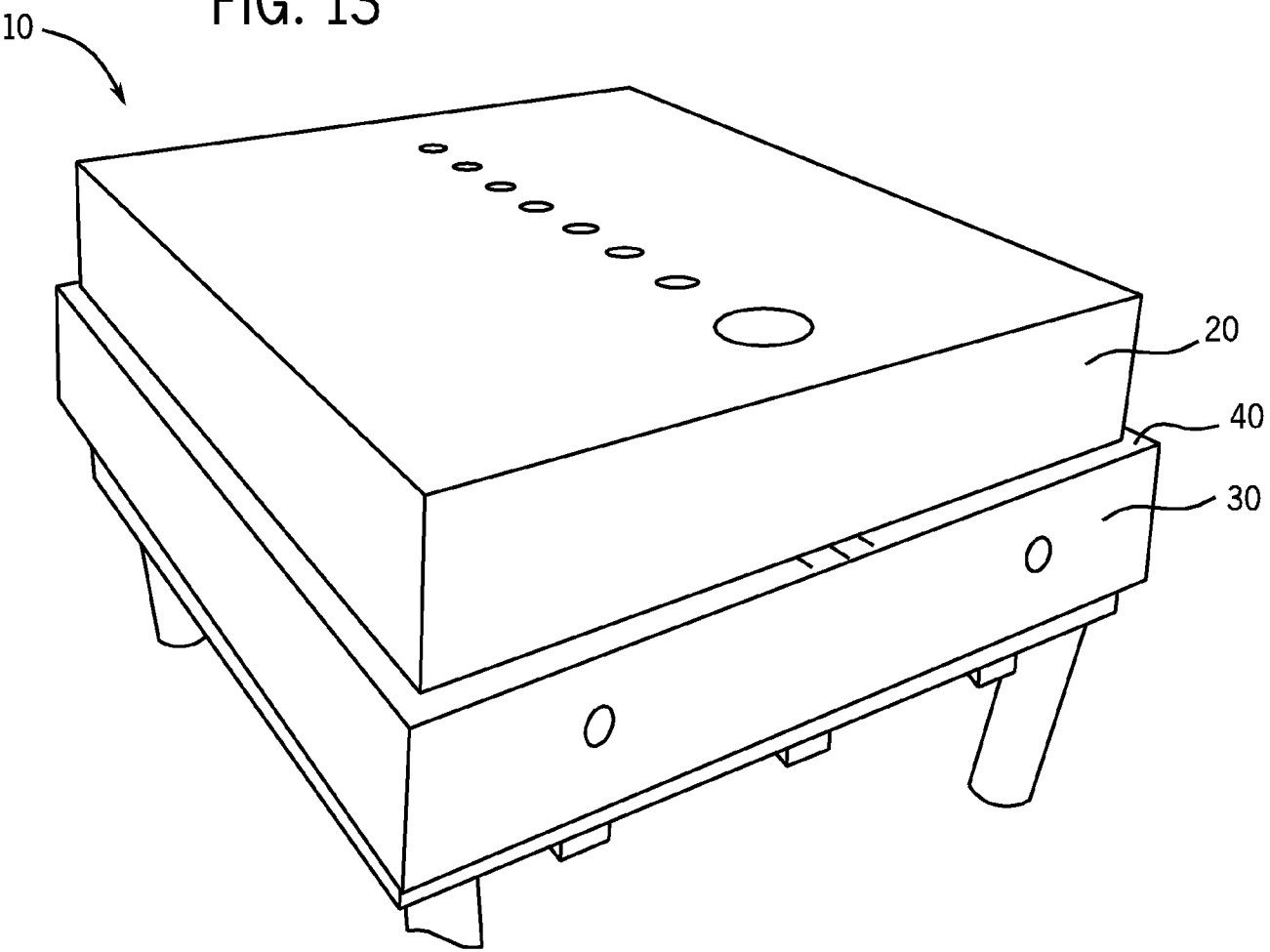
FIG. 13 is a top perspective view of a finished mold with a thicker cope.

In some cases, it may be advantageous to use a standard thickness cope 20. For example, a short production run may not justify the expense of creating a new configuration of cope plate 90. In such cases, a thin layer of a sand/binder mixture is distributed over the barrier 40 and allowed to cure, forming a thin cope 20. Once the thin cope 20 has sufficiently hardened, additional sand/binder mixture can be added to reach a traditional cope 20 thickness, obviating the need for a cope plate 90. For purposes of comparison, FIG. 13 shows an IPCM mold 10 for the same casting but made with a traditional cope 20 thickness.

As seen in the above detailed description and in the drawings, there are numerous advantages in using and in-place cope molding process. The cope 20 can be much thinner, as handling strength is no longer a consideration, resulting in much lower sand and binder costs. The labor required to mold the cope 20 is typically less than with traditional methods, and labor and equipment to turn over the cope 20 is eliminated. Additionally, because the barrier 40 may be selected to allow close conformance to the variations in height of the mold cavity 60 features, gaps between the cope 20 and drag 30 are reduced or eliminated, greatly reducing the occurrence of flash and subsequent requirements for grinding.

Although the invention has been herein described in what is perceived to be the most practical and preferred embodiments, it is to be understood that the invention is not intended to be limited to the specific embodiments set forth above. Rather, it is recognized that modifications may be made by one of ordinary skill in the art of the invention without departing from the spirit or intent of the invention and, therefore, the invention it so be taken as including all reasonable equivalents to the subject matter of the appended claims and the description herein.

What is claimed is:

1. A sand-based mold comprising:

a drag layer, the drag layer including a mold cavity formed therein;

a cope layer formed on top of the drag layer, wherein the cope layer is formed after the mold cavity; and a barrier affixed on top of the drag layer, without extending into the mold cavity, to allow the cope layer to be formed in place on top of the drag layer.

2. The sand-based mold of claim 1 further comprising sprues attached through the barrier to provide entryways for filling the mold cavity with metal.

3. The sand-based mold of claim 1 further comprising vents attached through the barrier to allow fluids to escape the mold.

4. The sand-based mold of claim 1 further comprising flow-offs attached through the barrier to allow fluids to escape the mold, wherein the flow-offs also allow a small amount of metal to flow into them.

5. The sand-based mold of claim 1 further comprising risers attached through the barrier, wherein the risers allow metal to flow into them.

6. The sand-based mold of claim 1 wherein a cope plate is placed on top of the cope layer to counteract forces on the cope layer created by pressure formed from metal filling the mold cavity.

7. The sand-based mold of claim 1 wherein the barrier is affixed to the drag layer by an adhesive.

8. A method of making a sand-based mold comprising:

forming a drag layer including a mold cavity;

affixing a barrier to the drag layer without extending into the mold cavity; and forming a cope layer in place on top of the drag layer, wherein the barrier separates the drag layer from the cope layer.

9. The method of claim 8 wherein the drag layer and cope layer consist of a mixture, the mixture including sand and a binder material.

10. The method of claim 9 wherein the drag layer is formed by pouring the mixture onto a pattern.

11. The method of claim 10 wherein the drag layer is removed from the pattern and the resulting drag layer contains a mold cavity.

12. The method of claim 8 wherein the drag layer further comprises a mold cavity, the mold cavity formed by machining the mold cavity into the drag layer.

13. The method of claim 9 wherein the cope layer is formed by pouring the mixture over the barrier affixed to the drag layer.

14. A method of making method of making a sand-based mold for a metal casting comprising:

forming a first layer, the first layer consisting of a sand/binder mixture, wherein the mixture is poured to a desired shape and cured to a solid state;

machining a cavity into the first layer, wherein the cavity is the shape of the desired casting, and wherein the cavity can be filled with molten metal which cools to form the casting;

affixing a barrier to the first layer without extending into the cavity; and forming a second layer, the second layer consisting of a sand/binder mixture, wherein the mixture is poured over the barrier affixed to the first layer and cured to a solid state.

* * * * *